United States Patent [19]

Jones

[11] 3,945,525

[45] Mar. 23, 1976

[54] CLOSURE SYSTEM FOR MEDICAL LIQUID CONTAINER HAVING LOW-TORQUE BREAKAWAY RING

[75] Inventor: Eugene C. Jones, Los Alamitos, Calif.

[73] Assignee: American Hospital Supply Corporation, Evanston, Ill.

[22] Filed: June 6, 1974

[21] Appl. No.: 477,310

[52] U.S. Cl. ..... 215/232; 215/32; 215/253; 215/295

[51] Int. Cl.[2] ..... B65D 41/32

[58] Field of Search ..... 205/232, 253, 295, 208, 205/217, 218, 223, 259, 337, 32

[56] References Cited

UNITED STATES PATENTS

| | | | |
|---|---|---|---|
| 2,140,732 | 12/1938 | Burke | 215/251 |
| 3,025,989 | 3/1962 | Williams | 215/257 |
| 3,422,978 | 1/1969 | Quackenbush | 215/220 |
| 3,730,372 | 5/1973 | Komendowski | 215/32 |

*Primary Examiner*—William Price
*Assistant Examiner*—Ro E. Hart
*Attorney, Agent, or Firm*—Dawson, Tilton, Fallon & Lungmus

[57] ABSTRACT

A closure system for a medical liquid container having a dispensing outlet surrounded by a flange over which is fitted a plastic cap. The cap is externally threaded and has an outwardly-projecting brim at its lower end overlying the flange. The brim is sealed to the flange along an annular zone having an inner boundary defining an annular line of weakness, and an internally-threaded breakaway ring is threadedly disposed on the cap. The breakaway ring includes a plurality of circumferentially-spaced depending projections for stressing the brim along portions of the annular line of weakness and for initiating and propagating the rupture of the brim as the breakaway ring is screwed downwardly upon the cap.

18 Claims, 5 Drawing Figures

CLOSURE SYSTEM FOR MEDICAL LIQUID CONTAINER HAVING LOW-TORQUE BREAKAWAY RING

BACKGROUND

Co-pending co-owned application Ser. No. 338,685, filed Mar. 7, 1973, discloses a closure for a medical liquid container having a cap which is separately formed with a thin integral brim overlying and hermetically sealed to the neck flange of the container. An inner boundary of the annular fusion joint provides a line of structural weakness which is ruptured when a breakaway ring, or jacking ring, is threaded downwardly over the cap and into forceful engagement with the brim of the cap. The intermeshing threads of the cap and breakaway ring are left-handed; therefore, a user simply rotates the breakaway ring (which has the appearance of an external cap) in a conventional counterclockwise direction when the container is to be opened. Because of the left-handed nature of the threads, the breakaway ring is actually forced downwardly towards the brim and neck flange of the container and it is the inner cap which is forced upwardly. Such upward force results in a rupture of the brim along its annular line of weakness and the combined cap and brim are then removed as a unit from the container.

While such a construction is highly effective in maintaining a bacteria-tight seal and also insures that the mouth of the dispensing outlet will not become contaminated by the brim of the cap as the cap is removed, the twisting force necessary to rupture the brim along its line of weakness has been found to be undesirably high. To reduce the twisting force which a user must apply to cause such rupture, the brim might be substantially reduced in thickness and might even be scored; however, the advantage of possible reduction in operating torque which such modifications might provide would be more than offset by the greater difficulties of manufacture and the increased possibilities of bacterial invasion and contamination should the brim inadvertently separate during normal handling, processing, and storage.

The following patents are further illustrative of the efforts of others in this field: U.S. Pat. Nos. 3,730,372, 3,597,793, 2,317,420, 3,517,847, 3,767,076, 2,140,732, 3,394,831, 3,393,818, 2,851,201, 2,040,789, 3,443,711, 3,025,988, 3,640,417, 3,108,708, 3,804,282, 3,058,631, and 3,784,282.

SUMMARY

This invention is concerned with a container closure construction in which relatively low torque is required for operation of the breakaway ring but which does not involve altering the brim thickness or construction, or in making any changes in the cap which might possibly present contamination problems during processing, handling and storage of the container.

Briefly stated, the improvement lies in forming at least one downwardly-tapered projection along the bottom of the breakaway ring. In the best mode presently known for practicing the invention, a plurality of such projections are provided, each projection including a pair of downwardly-extending surfaces which meet along a generally radially-oriented bearing edge. One of the surfaces of each projection, the leading surface thereof, slopes downwardly towards that edge at an angle within the range of 1° to 20° measured from a plane normal to the rotational axis of the ring, the preferred range being 2° to 10°, with the optimum angle believed to be about 5°. Four such projections have been found particularly effective although a greater or smaller number might be provided.

The depending projections are formed integrally with the ring (which in turn is preferably formed of rigid plastic material) and are engagable with the brim of the cap adjacent the outside edge of its annular line of weakness to initiate and propagate the rupturing of the brim as the ring is threaded downwardly to direct the projections into forceful sliding engagement with the brim. Initiation of the rupturing occurs because each projection localizes the downward force of the cap to cause slight deformation of the brim and to stress the brim in the zones of contact with the tapered projections. Once rupture has been initiated, the lines of stress about the brim developed by each of the projections continue along the paths of movement of those projections and thereby result in propagation of the ruptures.

Other advantages and objects of the invention will become apparent from the specification and drawings.

DRAWINGS

DESCRIPTION

Figure 2:
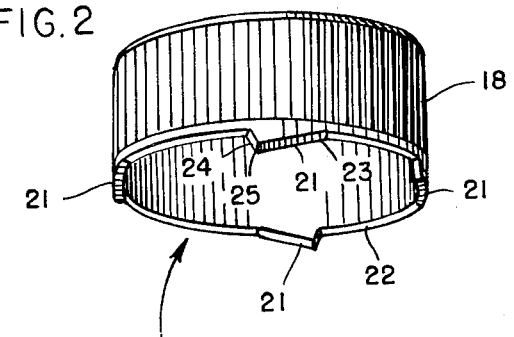
FIG. 2 is a perspective view of the breakaway or jacking ring of the closure.
Figure 1:
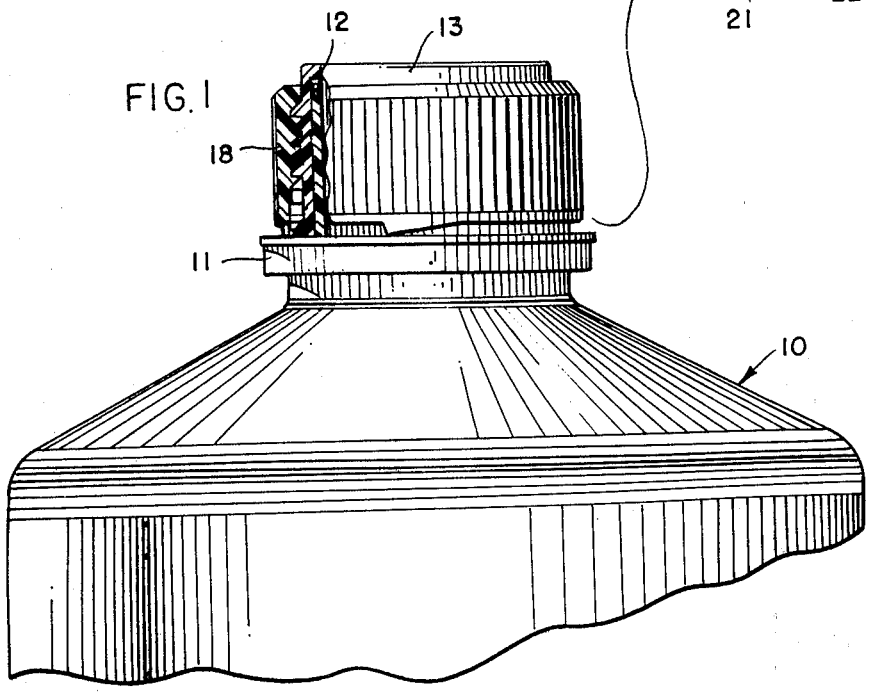
FIG. 1 is a fragmentary elevational view, taken partly in section, showing the upper portion of a medical liquid container equipped with a closure system embodying the present invention.

Referring to the drawings, the numeral 10 generally designates a container or bottle having an annular collar or flange 11 and an integral upstanding neck 12 of reduced diameter, the neck and collar together defining the dispensing outlet for the container. A cap 13 fits over the neck and thereby covers the outlet. As shown most clearly in FIGS. 4 and 5, the cap includes a top wall 14 and a generally cylindrical side wall 15. A slight space 16 is provided between the cap's side wall 15 and the outer surface of the neck 12, such space facilitating the assembly and removal of the cap from the neck.

The opposing surfaces of the neck 12 and side wall 15 are smooth to permit axial separation of the parts without resistance. Should it be desirable to thread a cap directly upon neck 12, then the outer surface of the neck would be provided with threads and a secondary inner cap (not shown) with complementary threads would be fitted upon the neck, the secondary cap providing a substantially smooth (unthreaded) outer surface similar to the outer surface of neck 12 as illustrated and bearing the same relationship with the inner surface of cap 13 as represented in the drawings between cap 13 and neck 12.

At the lower end of the cap's side wall 15 is an annular outwardly-projecting brim 17. The brim extends along a plane normal to the longitudinal axis of the cap and has a minimum thickness within the range of approximately 0.005 to 0.050 inches (0.127 to 1.27 millimeters). The thickness of the brim depends in part on the size of the container and the material from which the container and cap is fabricated; however, the brim must be of sufficient thickness and strength to withstand not only the normal forces incurred during handling but also the internal pressures created when the container and its contents are sterilized in an autoclave at temperatures ranging between 240° to 260°F. (116° to 127°C.).

It will be observed that the brim is provided with an outer portion 17*a* which is hermetically sealed, preferably by thermal fusion, to the outer top surface of neck flange 11. The inner boundary of sealed annular portion 17*a* defines an annular line or zone of brim weakness 17*b*. Within that line of weakness, the brim and cap remain unsealed to flange 11. Thus, rupturing of the flange along line 17*b* permits the cap 13 to be lifted free of neck 12.

The breakaway ring for rupturing the brim along its line of structural weakness is generally designated by numeral 18. The inner surface of the ring is provided with threads 19 which intermesh with threads 20 on the outside of cap 13. Left-handed threads are preferred so that when the breakaway ring 18 is rotated in a counterclockwise direction, the ring will be urged downwardly rather than upwardly.

As illustrated most clearly in FIG. 2, ring 18 has a plurality of uniformly and circumferentially spaced projections 21 along the otherwise planar undersurface 22 thereof. Each depending projection tapers downwardly, having a pair of surfaces 23 and 24 which meet along a generally radially oriented bearing line 25. It is to be noted that leading surface 23 (i.e., the surface which faces partially in the direction of ring rotation when the ring is operated to rupture the brim) slopes gradually downwardly at an angle *x* (FIG. 3) within the range of about 1° to 20° when measured from a plane normal to the axis of rotation of the ring. The preferred range is believed to be approximately 2° to 10°, the particular angle shown in the drawings being approximately 5°.

At least two circumferentially-spaced projections should be provided to minimize canting of the breakaway ring and avoid possible jamming of the threads during operation of the ring. While there appears to be no sharply-defined upper limit, it is believed that more than six such projections would result in an undesirable increase in the area of contact between the parts. Four such projections has been found particularly effective, apparently because the contact areas are sufficiently limited and, at the same time, there are enough projections to insure that during a rupturing or separating operation the lines of sliding engagement between the brim and the projections, taken in the aggregate, will approach the total circumference of the brim measured along the line of structural weakness.

The breakaway ring may be formed of any relatively hard, strong material. Metal may be used, although a rigid plastic such as SAN (styrene-acrylonitrile), medium impact styrene, acetal, or ABS (acrylonitrile-butadiene-styrene) is preferred. In general, the plastic material from which the container and cap are formed should be softer and more resilient. While a number of plastics might be suitable, polyolefins, such as a polyallomer (propylene-ethylene copolymer) thermoplastic material, have been found particularly suitable.

Figure 3:
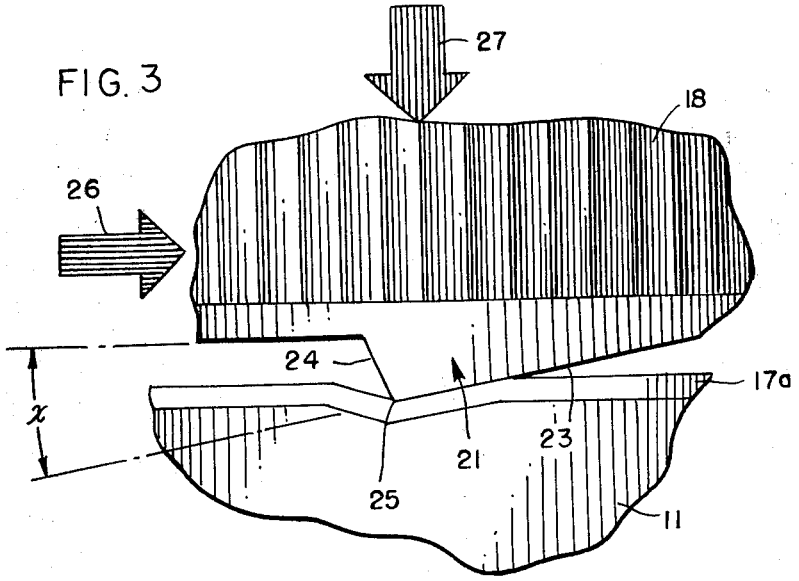
FIG. 3 is a greatly enlarged and somewhat schematic view of the cooperative relationship between one of the projections of the breakaway ring and the brim of the container cap as the container is being opened.
Figure 4:
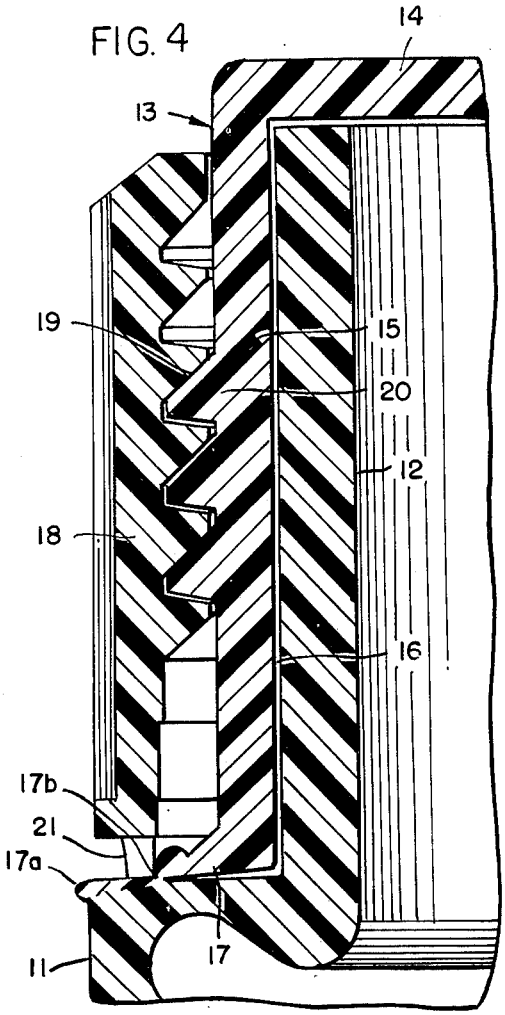
FIG. 4 is an enlarged fragmentary sectional view of the closure system when the container is in its normal sealed condition.
Figure 5:
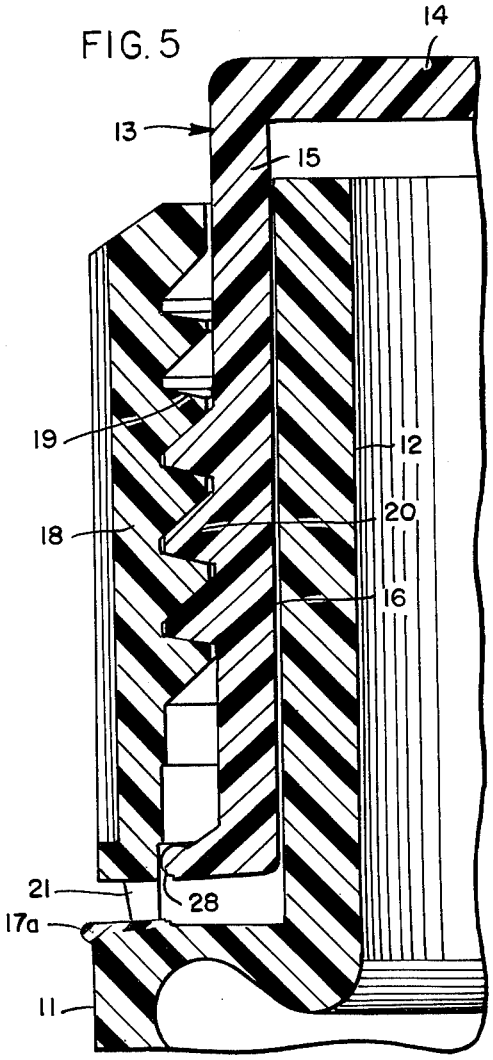
FIG. 5 is an enlarged sectional view similar to FIG. 4 but showing the closure system immediately after the cap's frangible brim has been ruptured.

As shown in FIG. 3, rotation of the breakaway ring 18 in a counterclockwise direction (when viewed from above) as represented by arrow 26 results in the ring being screwed downwardly as indicated by arrow 27. Because of the threaded engagement between cap 13 and ring 18, a corresponding upward force is exerted on the cap which projects upwardly through the ring. As the twisting movement is continued, the tapered projections 21 deform brim portion 17*a* in the manner somewhat schematically illustrated in FIG. 3, with the inclined leading surfaces 23 of the projections serving as moving ramps which bear forcibly downwardly to stress the brim in localized areas along the line of weakness 17*b* (FIG. 4). The result is that the projections initiate the rupturing of the brim along the line of structural weakness and, as rotation of the ring is continued, such projections also serve to propagate the rupture until finally the cap is separated from the sealed portion 17*a* of the brim by a clean break 28 formed along the previous line of weakness 17*b* (FIG. 5).

The superiority in ease of operation of a closure in which the breakaway ring is provided with projections or lugs of the type shown in the drawings, in contrast to a closure having a breakaway ring lacking such projections, is illustrated in the following chart based on test studies comparing 50 of each type of closure.

| | Peak Removal Torque (inch-pounds) | | | |
|---|---|---|---|---|
| | Minimum | Maximum | Average | Standard Deviation |
| Closure with Projections | 11 | 25 | 15 | 2.35 |
| Closure without Projections | 17 | 51 | 27 | 5.32 |

It will be observed that the maximum torque required in the operation of a closure having a breakaway ring equipped with such projections is approximately one half of the maximum torque required for the operation of a similar closure in which such projections are omitted. Such greater ease of removal is achieved without scoring, reducing, or weakening the brim prior to forceful manipulation of the breakaway ring. Thus, ease of removability is achieved without structural changes that might increase risks of accidental rupture during handling, processing (sterilization), or storage.

While in the foregoing an embodiment of the invention has been disclosed in considerable detail for purposes of illustration, it will be understood by those skilled in the art that many of the details may be varied without departing from the spirit and scope of the invention.

I claim:

1. A container for storing and dispensing sterile liquids, said container having a dispensing outlet surrounded by a flange, an externally-threaded cap fitting over the outlet and having an outwardly-projecting brim at its lower end overlying said flange, said brim being sealed to said flange along an annular zone having an inner boundary defining an annular line of weakness of said brim, and an internally-threaded breakaway ring threadedly disposed on said cap, wherein the improvement comprises said breakaway ring having a plurality of torque-reducing circumferentially-spaced depending projections for slidably engaging and stressing said brim along portions of said annular line of weakness and for initiating and propagating the rupture of said brim as said ring is threaded downwardly to force said cap upwardly away from said container.

2. The container of claim 1 in which said projections taper downwardly to define narrow bearing edges for engagement with said brim.

3. The container of claim 1 in which said flange and brim are thermoplastic and are heat sealed together along said annular zone.

4. The container of claim 3 in which said thermoplastic material is polyolefin.

5. The container of claim 4 in which said polyolefin is propylene-ethylene copolymer.

6. The container of claim 3 in which said breakaway ring is formed of a material having greater hardness than said thermoplastic material of said brim and flange.

7. The container of claim 2 in which said projections and cap are integrally formed.

8. The container of claim 6 in which said breakaway ring is provided with two to six of said projections.

9. The container of claim 8 in which said ring is provided with four of said projections.

10. A container for storing and dispensing sterile liquids, said container having a dispensing outlet surrounded by a flange, an externally-threaded cap fitting over the outlet and having an outwardly-projecting brim at its lower end overlying said flange, said brim being sealed to said flange along an annular zone having an inner boundary defining an annular line of weakness of said brim, and an internally-threaded breakaway ring threadedly disposed on said cap, wherein the improvement comprises said breakaway ring having a plurality of torque reducing circumferentially-spaced depending projections engagable with said brim along said line of weakness, each of said projections having a pair of downwardly extending surfaces meeting along a generally radially-directed bearing edge, said edge and at least one of the surfaces adjacent thereto being slidably engagable with said brim for stressing the same along a portion of said annular line of weakness for initiating and propagating rupture of the brim as said ring is forcefully threaded downwardly.

11. The container of claim 10 in which said one surface is a leading surface facing partially in the direction of rotation of said ring as the same is threaded downwardly upon said cap, said leading surface sloping gradually downwardly towards said bearing edge.

12. The container of claim 11 in which said leading edge slopes downwardly at an angle within the range of 1° to 20° measured from a plane normal to the rotational axis of said ring.

13. The container of claim 12 in which said angle falls within the range of about 2° to 10°.

14. The container of claim 12 in which said angle in approximately 5°.

15. The container of claim 10 in which said ring is provided with two to six of said projections.

16. The container of claim 15 in which said ring is provided with four of said projections.

17. The container of claim 10 in which said projections and cap are formed integrally of a rigid plastic material, said brim being formed of a plastic material softer than the material of said ring and projections.

18. A container for storing and dispensing sterile liquids, said container having a dispensing outlet surrounded by a flange, an externally-threaded cap fitting over the outlet and having an outwardly-projecting brim at its lower end overlying said flange, said brim being sealed to said flange along an annular zone having an inner boundary defining an annular line of weakness of said brim, and an internally-threaded breakaway ring threadedly disposed on said cap, wherein the improvement comprises said breakaway ring having at least one downwardly tapered depending projection for slidably engaging and stressing said brim along said annular line of weakness and for initiating and propagating the rupture of said brim as said ring is threaded downwardly to force said cap upwardly away from said container.

* * * * *